US005141080A

United States Patent [19]

Kujala

[11] Patent Number: 5,141,080

[45] Date of Patent: Aug. 25, 1992

[54] DEVICE AND PROCEDURE FOR OPENING OF AN ELEVATOR

[75] Inventor: Matti Kujala, Hyvinkaa, Finland

[73] Assignee: Kone Elevator GmbH, Baar, Switzerland

[21] Appl. No.: 672,481

[22] Filed: Mar. 20, 1991

[30] Foreign Application Priority Data

Mar. 21, 1990 [FI] Finland ..... 901411

[51] Int. Cl.[5] ..... B66B 13/12

[52] U.S. Cl. ..... 187/52 LC; 187/56; 187/63

[58] Field of Search ..... 187/51, 52 LC, 53, 56, 187/63, 64, 65, 103, 104, DIG. 1

[56] References Cited

U.S. PATENT DOCUMENTS 3,231,048 1/1966 Mitchell ..... 187/51
3,783,977 1/1974 Voser ..... 187/52 LC X

FOREIGN PATENT DOCUMENTS 1254291 1/1961 France .
54-149156 11/1979 Japan .
1-267289 10/1989 Japan .

*Primary Examiner*—Robert P. Olszewski
*Assistant Examiner*—Dean A. Reichard
*Attorney, Agent, or Firm*—Kenyon & Kenyon

[57] ABSTRACT

The invention relates to an elevator door opening device designed for opening the car doors and the landing doors. The door opening device comprises a power means and a door coupling apparatus for opening and closing the car and landing doors essentially simultaneously. According to the invention, the door coupling apparatus engages both the car door and the landing door when the car is at a landing, in such manner that its travel during the opening and closing motion of the doors is essentially shorter than the travel of the doors, and that the door coupling apparatus is located outside the area delimited by the landing doorway.

9 Claims, 2 Drawing Sheets

DEVICE AND PROCEDURE FOR OPENING OF AN ELEVATOR

BACKGROUND OF THE INVENTION

1. Field of the Invention

The present invention relates to an opening device and to a procedure for opening the doors of an elevator.

2. Description of Related Art

The doors of present-day elevators mainly consists of double doors, the movable car being provided with a door or doors that move along with it, while the elevator shaft has separate doors at each landing. When the car is at a given landing, the doors of the car and those at the landing are opened simultaneously. In the elevator constructions currently used, simultaneous opening is implemented by providing the space between the car door and the landing door with so-called door coupling elements. These consist of suitable gripping elements mounted on the car door and of counter-elements mounted at a corresponding location on the landing door. Thus, when the car doors are moved using a power means provided on the car, the landing doors will be moved along with them.

The mutually corresponding parts of the door coupling apparatus are so arranged relative to each other that they can move past each other when the car is travelling in the elevator shaft, but when the car is at a landing and the car door is moving horizontally, said parts of the door coupling apparatus engage each other. Due to this mode of operation, corresponding parts of the door coupling apparatus must extend towards each other from the car door and from the landing door. Therefore, they require a certain space between the car and the landing. A corresponding space or gap is thus also formed between the car door sill and the landing door sill, and all traffic between the car and the landing must therefore pass over this relatively wide gap.

Another problem in existing door coupler systems is that, since the door coupling apparatus must unlock the landing doors before they can be opened, the car door has to be opened first e.g. by 10–20 mm, this motion causing the landing door to be unlocked, and it is only after this that the landing door can move along with the car door. This difference between the doors which appears at the beginning of the opening operation is maintained as long as the doors remain open, so that the width of the door actuating mechanism has to be increased by a corresponding amount.

In addition to the aesthetic drawback involved, the above-mentioned difference may cause problems in the operation of the capacitive safety edge of the elevator doors, because, due to said difference, the safety edge cannot "see" beyond the landing door. Thus, a blind space is formed between the doors, creating a potential danger to safe operation of the door.

SUMMARY OF THE INVENTION

The object of the present invention is to eliminate the above drawbacks. A specific object of the invention is to provide an opening mechanism for the doors of elevator cars and a corresponding procedure which will permit the opening and closing of the elevator doors to be implemented using solutions taking up a minimal space, thus minimizing the opening width of the doors as well as the sill gap width.

The elevator door opening device of the invention comprises a power means which has a connection to the car doors and the landing doors and door coupling apparatus to enable the doors to be opened and closed essentially simultaneously. According to the invention, the door coupling apparatus is placed outside the area delimited by the car door and landing door openings in such a manner that, when the car is at a landing, the door coupling device engages both the car door and the landing door so that, when the doors are being opened or closed, its travel will be shorter than the travel of the doors. Thus, the door coupling apparatus is placed essentially outside the space between the doors when closed, i.e. at least completely outside the area delimited by the openings of the car and landing doors, and when the doors are opened, the door coupling apparatus may move relative to and with the doors, so that it will remain essentially between the doors.

In an embodiment of the invention, in which the power means is connected to the car door, the door coupling apparatus consists of a first connecting member which connects the car and the car door, a second connecting member which connects the landing and the landing door, a door coupler mounted on one of the connecting members and a door coupler counterpart mounted on the other connecting member.

The connecting members are preferably rigid and straight levers, bars or equivalent connected with turnable joints to the car, car door, landing, and landing door.

The lower ends of the connecting members are attached to stationary joints on the car and on the landing, in which case the upper ends of the connecting members must be allowed to move relative to the doors at least in the vertical direction. This motion can be implemented using another lever connected with joints between the door and the upper end of the connecting member, by providing the door with a vertical slide track, or by using a connecting member extending and shortening in a telescopic manner.

In another embodiment of the invention, the power means is connected to the door coupling apparatus, which is linked with the car door by a suitable power transmission arrangement and with the landing door by a corresponding power transmission arrangement in such a manner that when the car is at the landing, the power means acts on the door coupling apparatus, and both the car door and the landing door are moved essentially simultaneously.

Accordingly, a door opening device for an elevator, designed for opening car and landing doors, comprising a power means and a door coupling apparatus for opening and closing the car and landing doors essentially simultaneously, wherein said door coupling apparatus is located outside the area delimited by a car and a landing door opening, when the doors are in both opened and closed positions is provided.

Furthermore, a method for opening the doors of an elevator, whereby the car door is stopped when it is essentially directly opposite to the landing door, and the car door is opened with a power means, the landing door being opened together with the car door by means of a door coupling apparatus placed between the doors wherein the door coupling apparatus used in the method of the invention is a door coupler which remains outside the space between the doors when the doors are closed and which interacts with the doors by means of a suitable power transmission mechanism in such manner that when the doors are opened, the door coupler is enclosed in the space between the doors is also provided.

A possible solution is one in which, during the opening motion of the doors, the door coupler moves in the same direction but at a lower speed and through a shorter distance, so that, when the doors reach the fully open position, it will be enclosed between the doors, in the space delimited by the doors. Another possible solution is one in which the door coupler remains stationary relative to the car and moves the doors between the open and closed positions, being itself located between the doors when the latter are in the open position and essentially outside the space between the doors when the latter are in the closed position.

The advantages obtained by placing the door coupler outside the doorway area as provided by the invention include the following:

a very narrow gap between the car and landing sills is obtained;

in certain embodiments, by appropriate selection of the actuating lever sizes, the front edge of the car door may lead the landing door at the beginning of the opening motion, but in the fully open position the front edges are aligned with each other;

the space required for the lateral opening motion of the doors is minimized;

in certain embodiments, when the door is open, the weight of the actuating levers tends to keep the door open and when the door is closed, to keep it closed;

since the door coupler moves into the space between the doors when they are opened, the equipment does not require any extra space in the elevator shaft.

BRIEF DESCRIPTION OF THE DRAWINGS

In the following, the invention is described in detail by reference to the appended drawings, in which.

DESCRIPTION OF PREFERRED EMBODIMENTS

Figure 1:
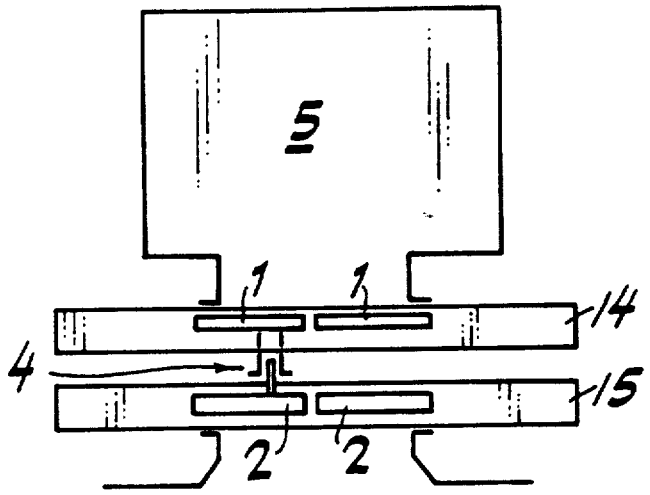
FIG. 1 PRIOR ART
FIG. 1 illustrates previously known elevator door opening techniques.

The state-of-the-art car door and landing door system illustrated by FIG. 1 comprises the car doors 1 provided on the elevator car 5 and the landing doors 2 provided at each landing. Attached to the car is a sill 14, and a similar sill 15 is provided at each landing. When the car is at a landing, the car doors and landing doors are opened and closed simultaneously by means of door coupling devices 4. The door coupling devices 4, attached to opposite faces of the doors 1 and 2, are placed between the doors.

In its simplest form, the door coupler attached to the car door consists of a vertical U channel, and the landing door is provided with a suitable counter-element, e.g. a pin or a stud, fitting into the U channel. The pin can move freely in the U channel in the vertical direction, but when the door is moved laterally, the pin will engage the U channel by its side wall and thus move the landing door along with the car door.

An important problem in such a construction is that a clearance, wide enough to permit vertical car travel must be provided between the door coupler attached to the car door 1 and the sill 15 at the landing floor edge, and a similar clearance must be provided between the coupling pin attached to the car door and the sill 14 of the elevator car. Moreover, there must be a certain depth of engagement between the pin and the door coupler U channel, which means that in practice the width of the gap between the sills 14 and 15 must be 20–30 mm. However, in many cases such a gap is too large or at least unpleasant when wheeled vehicles such as hospital beds or wheelchairs are to be moved across the sill.

Figure 2:
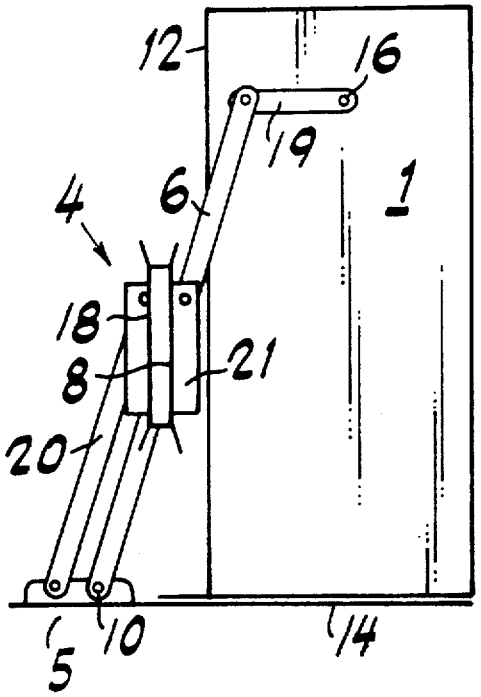
FIG. 2 illustrates a car door provided with a device of the invention.
Figure 3:
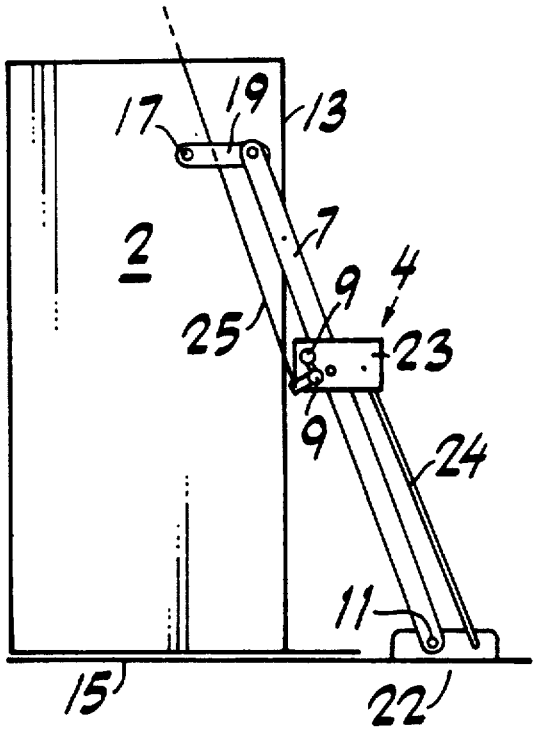
FIG. 3 illustrates a landing door, used in conjunction with the door shown in FIG. 2.
Figure 4:
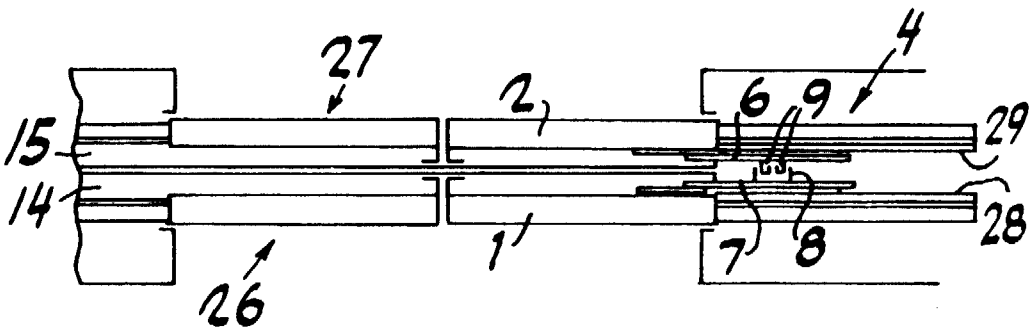
FIG. 4 shows a top view of the devices in FIGS. 2 and 3.
Figure 6:
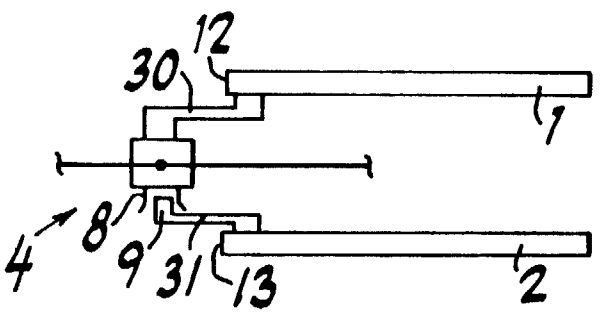
FIG. 6 illustrates the embodiment of FIG. 5 in top view.

The above-described problems in the state of the art are eliminated by embodiments of the door opening device of the invention, illustrated in FIGS. 2 and 3 and, in top view in FIG. 4.

The door opening device of the invention presented in FIGS. 2–4 comprises a first connecting member 6, a rigid bar pivoted at one end on a fulcrum 10 on the car 5 and connected via a joint at its other end to a connecting lever 19, which in turn is connected with a joint 16 at its other end to the car door 1. Connected with a joint to the car 5 is an auxiliary bar 20, which is parallel to the connecting member 6 and connected to it by means of a hinged brace plate 21, placed about the middle of the member 6, so that the member 6 and the auxiliary bar 20 always remain parallel and rotate simultaneously. Attached to the brace plate 21 is a pair 18 of guide tracks, constituting a door coupler 8. By virtue of the articulated construction described above, the guide tracks 18 always remain vertically oriented regardless of the motions of the connecting member 6 about its fulcrum 10.

The landing door 2 is provided with a substantially similar lever mechanism, i.e. a second connecting member 7, a rigid bar pivoted at one end on a fulcrum 11 on the landing 22 and connected via a joint at its other end to a connecting lever 19, which in turn is connected with a joint 17 at its other end to the landing door 2. At the middle part of the member 7 is a brace plate 23 hinged on an auxiliary bar 24 whose other end is pivoted on the landing 22. Thus, the brace plate 23 and the pin-like counter-elements 9 attached to it will move sideways along with the connecting member 7 while maintaining their orientation, although member 7 turns relative to the landing 22. The pins 9 together with the associated levers and bar 25 constitute a locking and opening mechanism known in itself, by means of which the landing door is opened and closed when the mechanism is actuated.

By virtue of the mechanism of the invention described above, the door coupling apparatus 4 i.e. the door coupler 8 and its counterpart 9, are placed outside the area of the doorways 26 and 27 (FIG. 4) of the elevator car and the landing 22. In practice, this generally also means that, when the doors 1 and 2 are closed, the door coupling apparatus 4 is located outside the outer vertical edges 12 and 13 of the doors 1 and 2. Therefore, the sills 14 and 15 in the doorway can be located very close to each other, e g. at a distance of 6 mm. A larger gap between the opposite sill edges, for installing the door coupling apparatus is provided only in the area outside the doorway area, i.e. in the area invisible to elevator users.

Another essential feature of the opening device illustrated in FIGS. 2–4 is that the device 4 moves more slowly than the doors when the latter are being opened. As a result, although the door coupling apparatus is located outside the door area when the doors are closed, the door coupling apparatus will be enclosed in the space between the car doors and the landing doors. Therefore, the door coupling apparatus does not require any extra space in the direction of door motion in addition to the space needed for the door leaves themselves.

Since the power means provided in the elevator car acts on the car door 1 first and the lock of the landing door has to be opened by the motion of the pins 9 of the door coupling apparatus 4, the two doors 1 and 2 will start moving at slightly different times. However, by selecting somewhat different lengths for the connecting members 6 and 7, i.e. making member 7 slightly longer than member 6, the landing door will move a little faster during the opening action, so that when the doors are completely open and side by side, they will be at exactly the same level in the lateral direction. This arrangement also reduces the structural width needed in the direction of door motion.

Moreover, the lever mechanism of the invention as presented in FIG. 2–4 effectively keeps the doors in their extreme positions because the connecting levers move across their fulcrum during the motion between the extreme door positions. Thus, due to gravity, the levers always push the doors toward the current extreme position and prevent the doors from moving freely.

Figure 5:
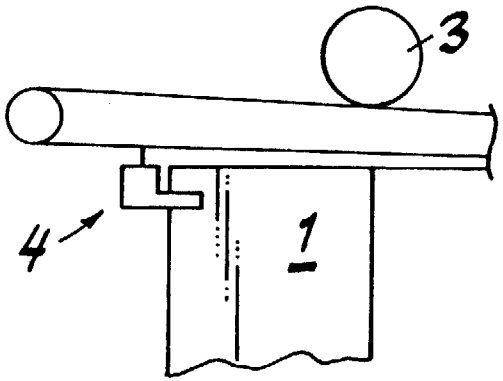
FIG. 5 shows a diagrammatic representation of another embodiment of the invention.

FIGS. 5 and illustrate another embodiment of the invention. In this solution, the power means 3 is connected to the door coupling apparatus 4, which, when the doors are closed, is located outside the outer vertical edges of the doors 1 and 2, i.e the door coupling apparatus 4 is not between the doors 1 and 2. The door coupling system has a suitable direct power transmission contact to the car door 1 and an essentially corresponding contact to the landing door 2, via a suitable door coupler 8 and counter-element 9, only when the car is at the landing.

The power transmission contacts 30 and 31 may consist of various turnable and jointed lever structures or they may comprise various motion transmitting cogged wheels or racks, belts or other power transmission systems known in themselves. In this embodiment, the door coupling apparatus 4 may be stationary and only move the doors 1 and 2 to opposite sides, away from the doorway when the doors should be opened, or it may move a certain distance in the direction of the door motion, so that it will still remain between the opened doors.

In the above, the invention has been described by the aid of examples with reference to the drawings attached, yet it can be implemented in various embodiments within the scope of the idea of the invention as defined in the claims.

We claim:

1. A door opening device for an elevator, designed for opening car and landing doors, comprising a door coupling apparatus for opening and closing the car and landing doors essentially simultaneously, the door coupling apparatus comprising:

a first connecting member, connecting an elevator car and the car door;

a second connecting member, connecting an elevator landing and the landing door;

a door coupler mounted on one of the connecting member; and a door coupler counterpart mounted on the other connecting member, wherein said door coupling apparatus is located outside the area delimited by a car and a landing door opening, when the doors are in both opened and closed positions and the weight of the first and the second connecting members maintains the car and the landing doors, in opened and closed positions, respectively.

2. A door opening device according to claim 1, wherein said first and second connecting members are essentially rigid levers, said first connecting member being connected with a car fulcrum to the car and with a first joint to said first connecting lever coupled to said car door; and said second connecting member being connected with a landing fulcrum to the landing and with a second joint to said second connecting lever coupled to said landing door.

3. A door opening device according to claim 2, wherein said car fulcrum of said first connecting member is located on the car at a distance away from an outer vertical edge of the car door when the car door is in the closed position and said landing fulcrum of said second connecting member is located on the landing at a distance away from an outer vertical edge of the landing door, when the landing door is in the closed position.

4. A door opening device according to claim 2, wherein the lengths of said first and said second connecting members are different from each other and are selected such that the vertical edges of the car and landing door, when travelling, remain substantially aligned.

5. A door opening device according to claim 1 comprising a first joint between the first connecting member and the car door and a second joint between the second connecting member and the landing door.

6. A door opening device according to claim 1, wherein said door coupler is mounted on said first connecting member and said door coupler counterpart is mounted on the second connecting member.

7. A door opening device according to claim 1, wherein a power means for activating the car and landing doors is connected to the door coupling apparatus, which is linked via a power transmission arrangement with the car door and the landing door.

8. A method for opening the doors of an elevator comprising the steps of:

a) stopping the elevator car when an elevator car door is essentially squarely opposite an elevator landing door, b) opening the car door with a power means, c) opening the landing door together with the car door by means of a door coupling apparatus placed between the doors which, when the car and landing doors are in the closed position, is located outside the space between said car and landing doors and, when the doors are in the opened position, is enclosed in the space between them, and d) maintaining said car and landing doors in an opened or closed position using the weight of a first and a second connecting member, respectively, of said door coupling apparatus.

9. A door opening device for an elevator, designed for opening car and landing doors, comprising a door coupling apparatus for opening and closing the car and landing doors essentially simultaneously, the door coupling apparatus comprising:

a first connecting member, connecting the car and the car door;

a second connecting member, connecting the landing and the landing door;

a door coupler mounted on one of the connecting member; and a door coupler counterpart mounted on the other connecting member, wherein said first and second connecting members are essentially rigid levers, connected with joints to the car and to the landing, respectively, wherein a car fulcrum of said first connecting member is located on the car at a distance away from an outer vertical edge of the car door when the car door is in the closed position and essentially at the height of a car sill, and a landing fulcrum of said second connecting member is located on the landing at a distance away from an outer vertical edge of the landing door essentially at the height of a landing sill; and wherein said door coupling apparatus is located outside the area delimited by a car and a landing door opening, when the doors are in both opened and closed positions.

* * * * *